United States Patent [19]

Gabriels

[11] Patent Number: 4,846,070

[45] Date of Patent: Jul. 11, 1989

[54] TELESCOPIC GRENADE

[75] Inventor: André Gabriels, Genk, Belgium

[73] Assignee: Fabrique Nationale Herstal, en abrege FN, societe anonyme, Herstal, Belgium

[21] Appl. No.: 98,209

[22] Filed: Sep. 18, 1987

[30] Foreign Application Priority Data

Oct. 7, 1986 [BE] Belgium ..... 2/61065

[51] Int. Cl.[4] ..... F42B 11/42

[52] U.S. Cl. ..... 102/488; 102/482

[58] Field of Search ..... 102/482, 483, 484, 485, 102/487, 488; 42/105; 244/3.3

[56] References Cited

U.S. PATENT DOCUMENTS

| | | | |
|---|---|---|---|
| 1,463,993 | 8/1923 | Burt | 42/105 |
| 3,490,373 | 1/1970 | Fox | 102/488 |
| 3,960,084 | 6/1976 | Chavee . | |
| 4,023,499 | 5/1977 | Chavee . | |
| 4,395,836 | 8/1983 | Baker et al. | 42/105 |
| 4,448,129 | 5/1984 | Gabriels | 102/484 |

FOREIGN PATENT DOCUMENTS

| | | |
|---|---|---|
| 145696 | 6/1985 | European Pat. Off. . |
| 1394582 | 6/1963 | France . |
| 2214105 | 8/1974 | France . |

*Primary Examiner*—Deborah L. Kyle
*Assistant Examiner*—Richard W. Wendtland
*Attorney, Agent, or Firm*—Foley & Lardner, Schwartz, Jeffery, Schwaab, Mack, Blumenthal & Evans

[57] ABSTRACT

Telescopic grenade, characterized in that it features means (29–35) that ensure safety in the transport/storage position and means (22–19–20–21–29) that determine, under the effect of the propellent gasses, a relative transfer between the component parts (5–15) of the tail (2).

18 Claims, 4 Drawing Sheets

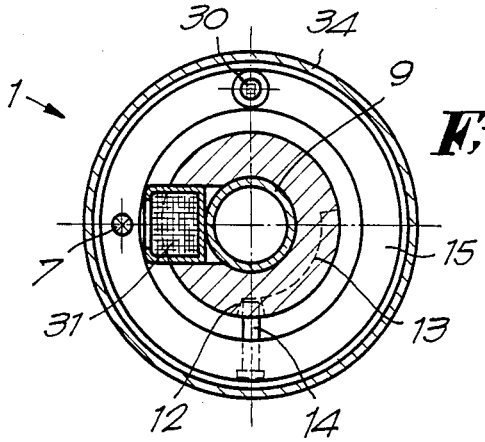
Fig. 3
Fig. 4
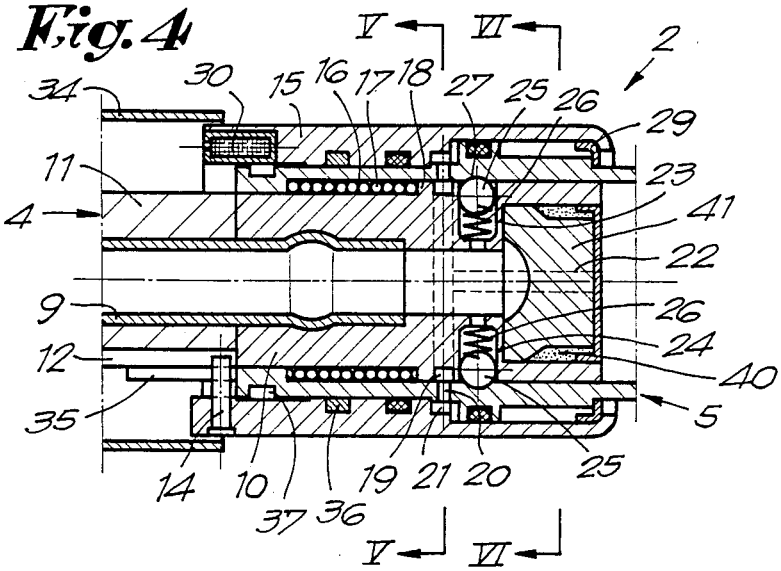
Fig. 5
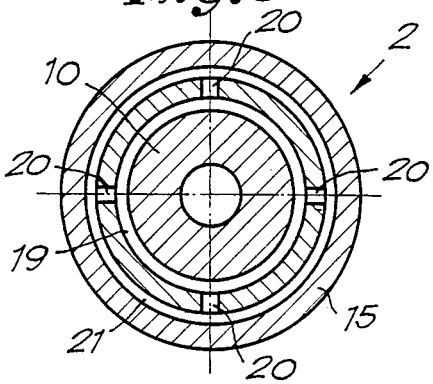
Fig. 6
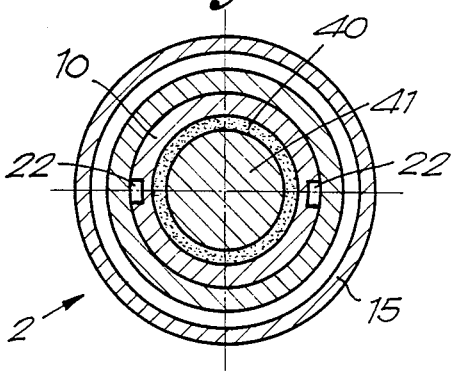

TELESCOPIC GRENADE

BACKGROUND OF THE INVENTION

This invention concerns a telescopic grenade, for instance, a grenade designed to be launched by means of a rifle and fitted with a caliber ring. We are already familiar with telescopic projectiles provided with a head extended by a tubular tail and containing an explosive charge as well as a detonator chain for the latter, with the aforesaid tail made of two telescopic tubular parts, one of which is firmly attached to the aforesaid head and carries together with the latter a first section of the aforesaid detonator chain, with the other part carrying the remaining section of this chain and with guiding means distributed on the aforesaid two parts so as to provide them with a specific angular position, depending on their relative axial position.

SUMMARY OF THE INVENTION

Although these well-known projectiles are very effective, this invention concerns such a projectile that features significant advantages in addition to the advantages of the projectiles already known.

These additional advantages are listed those below:

very simple and robust explosive charge;

very reliable system;

impact-proof system;

precise position and locking of telescopic elements in extended position;

a trajectory beginning position; and controllable impact sensitivity.

For this purpose, the projectile according to the invention consists substantially of a head extended by a tubular tail that contains an explosive charge as well as a detonator chain for the latter, with the aforesaid tail made of two tubular telescopic parts, one of which is firmly attached to the aforesaid head and carries, with the latter, a first section of the aforesaid detonator chain, with the other part carrying the remaining section of this chain and with this projectile provided with guiding means distributed on the aforesaid two parts so as to provide them with a specific angular position, depending on their relative axial position. This projectile is characterized in that it features a transport/storage position; means that determine the precise relative position of the parts; means that determine, under the effect of propellent gasses, a relative transfer between the component parts of the tail; means that prevent an untimely explosion and a trajectory beginning position.

BRIEF DESCRIPTION OF THE DRAWINGS

For the sake of greater clarity, one examplary embodiment of the invention is described below, for purposes of illustrating and without any restriction in mind, by referring to the appended drawings, where:

FIG. 3 shows an enlarged section according to line III—III of FIG. 2;

FIG. 4 shows an enlarged scale view of the part referred to by F4 in FIG. 2;

FIGS. 5 and 6 show sections according to lines V—V and VI—VI of FIG. 4;

DETAILED DESCRIPTION OF THE PREFERRED EMBODIMENTS

Figure 1:
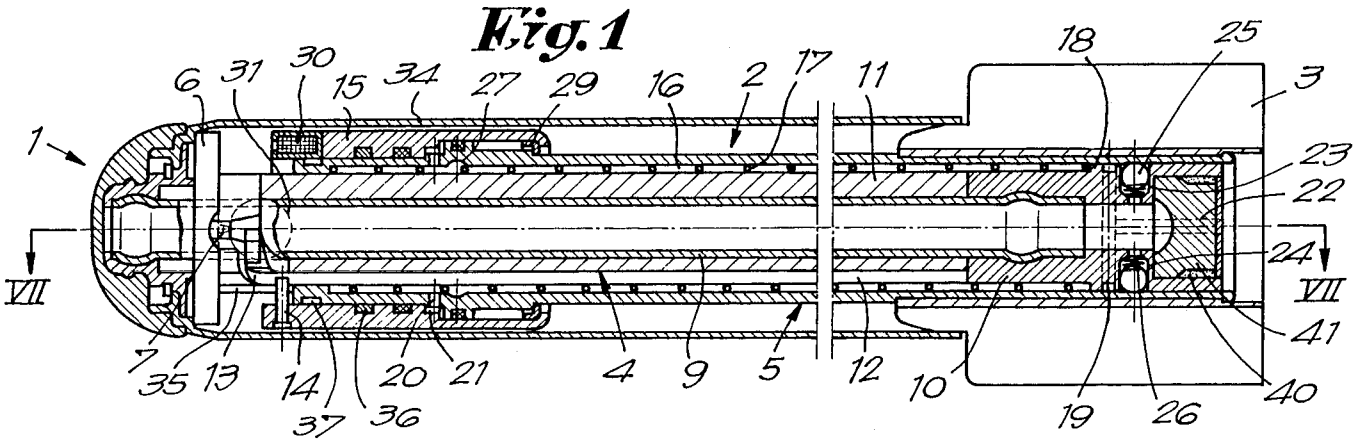
FIG. 1 shows a projectile according to the invention in storage and transport position.

The projectile shown by the figures has a head 1 and a telescopic tubular tail 2 with stabilizer 3. The tail 2 is made of two parts 4–5 of which part 4 is firmly attached to the head 1, with the part 5 able to slide around the first part. The head 1 has inside a plate 6 provided with a percussion tip 7 and a device 8 that prevents an involuntary explosion. The head 1 is fitted to the end of a casing 9, the other end of which is provided with a flange 10.

Around the casing 9 and between the plate 6 and the flange 10 is located a body 11 that constitutes the explosive charge of the projectile. This body 11 displays one single longitudinal groove 12 that extends at its end closest to the head 1, by a curved section 13.

With the groove 12–13 co-operates a finger 14 fitted in a case 15 assembled so that it slides axially on section 5 of the tail 2.

Between the two parts 4–5 is provided a chamber 16 in which is lodged a spring 17 that bears against a shoulder 18 of the flange 10. The latter features a circular groove 19 that communicates, in the position of FIG. 2, with radical holes 20 provided in the aforesaid part 5 and which communicate themselves with a circular chamber 21 in the case 15. Into the groove 19 emerge two grooves 22 that link the groove 19 with the inside of the aforesaid part 5. The flange 10 has two radial chambers 23–24 that house each one ball 25 prompted by a spring 26.

The aforesaid part 5 of the tail 2 features a groove 27 with which the balls 25 can co-operate.

The case 15 is fitted to the aforesaid pat 5 by means of a deformable bowl 29 that allows, subsequent to deformation, a transfer of the case 15 as compared to the part 5. In a groove of the case 15 is assembled an elastic locking ring 36 that can co-operate with a groove 37 in part 5.

The pyrotechnic detonator chai includes the percussion tip 7, a detonator 30 and a relay 31 sunk into the aforesaid explosive charge 11. The percussion tip 7 as well as the relay 31 are part of the head 1 while the detonator 30 is lodged in a notch of the case 15 that, in turn, is part of the telescopic tubular tail 2.

The aforesaid device 8 that prevents an untimely explosion in flight consists of a damper 32 of which the damping action is determined by a spring 33.

Finally, the head 1 is extended by a protective tube 34 for the explosive charge 11.

The projectile described above is used and functions in the following manner.

In the storage/transport position (FIG. 1), part 5 with case 15 takes up an angular position as compared to the head 1 and the part 4 in such a manner that the tip 7 is out of alignment with the detonator 30, with any relative movement of the part 5 as compared to the head 1 prevented by the contact of an extension 35 against the plate 6. The extension 35 may be fitted either to the aforesaid part 5 or to the plate 6.

To bring the projectile into firing position (FIG. 2), a traction is applied to the part 5. The finger 14 runs through the groove 12 until the balls 25 enter into the notches 27–28 and thus determine the precise relative position of the parts 4 and 5. In this position, the spring 17 is under pressure.

The projectile is ready to be engaged onto the flange at the end of the barrel of a rifle used for its launching.

During the launching, the propellent gasses penetrate via the grooves 22 into the circular groove 19 and thus via the holes 20 into the groove 21. Under the effect of the propellent gasses on the walls of this groove 21, the case 15 deforms the bowl 29 and changes position as compared to part 5. At the end of the run, the elastic ring 36 drops into the groove 37 and thus ensures the locking of the case 15 as compared to part 5. At the same time and under the action of the propellent gasses, the balls 25 move in the two radial chambers 23–24 against the pressure of the springs 26 with the latter exposed to a deformation such that they become inoperative.

After the grenade has left the flange of the rifle, the parts 4–5 of the projectile engage one into the other, together with the release of spring 17 and the aerodynamic forces, while the finger 14 runs first through the groove 12 and then through the groove 13.

Figure 7:
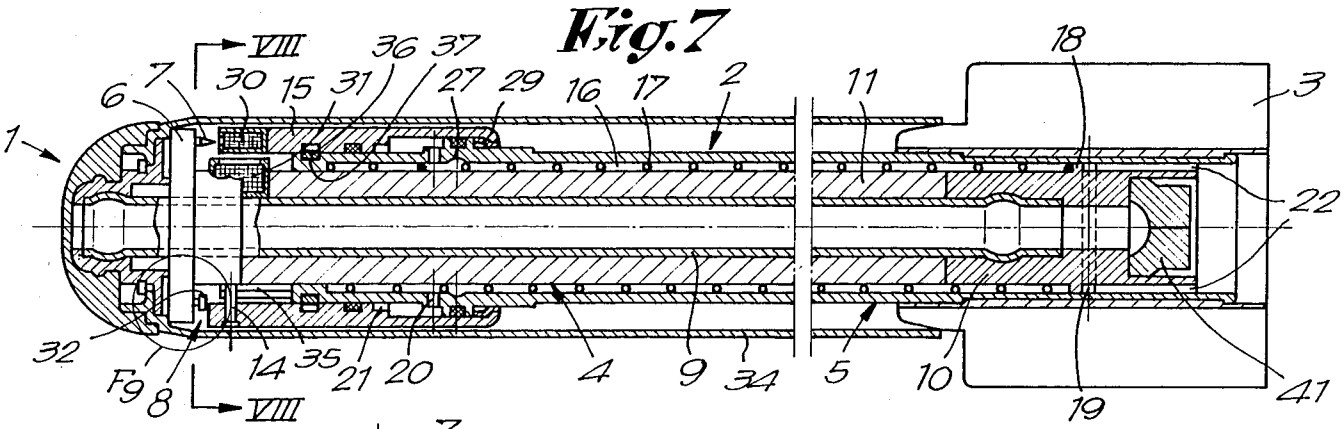
FIG. 7 shows the projectile according to FIG. 1 in the launched position i.e. subsequent to firing but prior to impact, specifically according to line VII—VII of FIG. 1.
Figure 9:
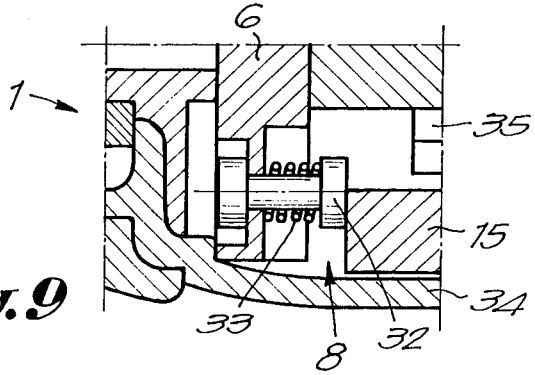
FIG. 9 shows an enlarged scale section of the part referred to by F9 in FIG. 7.
Figure 8:
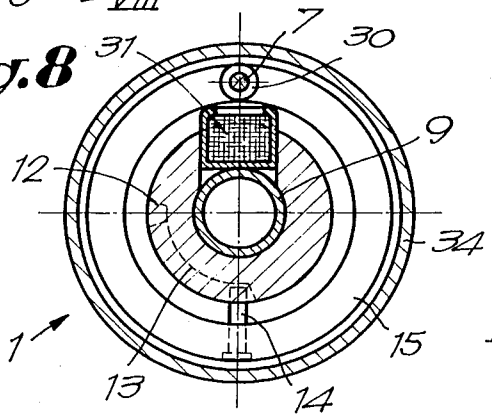
FIG. 8 shows a section according to line VIII—VIII of FIG. 7.

When the finger 14 enters the groove 13, it entails the rotation of part 5 as compared to the unit 1–4. The projectile is now in the position of FIG. 7 in which the pyrotechnic chain is in alignment.

In this position, the device 8 prevents any further progression of part 5 up to the time of impact. The spring 33 has been calculated, as a matter of fact, to avoid any untimely explosion, for instance through contact of the projectile with tropical rain etc.

At the time of impact, the substantial mass of part 5 is made to move and imparts all of its energy to the detonator when the latter is striking the firing pin.

Figure 2:
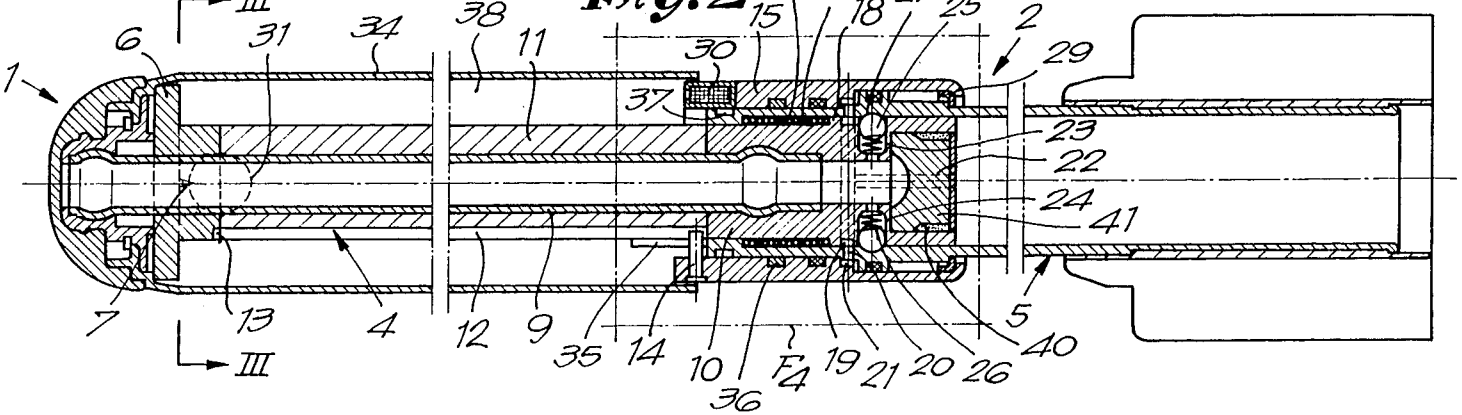
FIG. 2 shows the projectile according to FIG. 1 in launching position i.e. prior to firing.

A trajectory beginning position of the projectile according to the invention can be controlled through the presence of tube 34 with which case 15 is cooperating. During the progress of the latter in tube 34, as a matter of fact, it acts in there like a dash-pot slowing down the aforesaid progress to some extent while clearing via a calibrated opening, the air that is present in the free space 38, with the latter created when the projectile is in the position as shown by FIG. 2. The calibrated opening may be achieved by the radial clearance between the outer diameter of the case 15 and the inner diameter of the tube 34.

In a preferred embodiment, the aforesaid springs 26 will be calculated so that they remain deformed after the projectile has been launched in order to prevent any friction of the balls 25 against the inner wall of part 5.

As shown in the drawings, a back-up charge 40 may be lodged in the free space formed by the caliber ring plug 41 and the flange 10.

Figure 10:
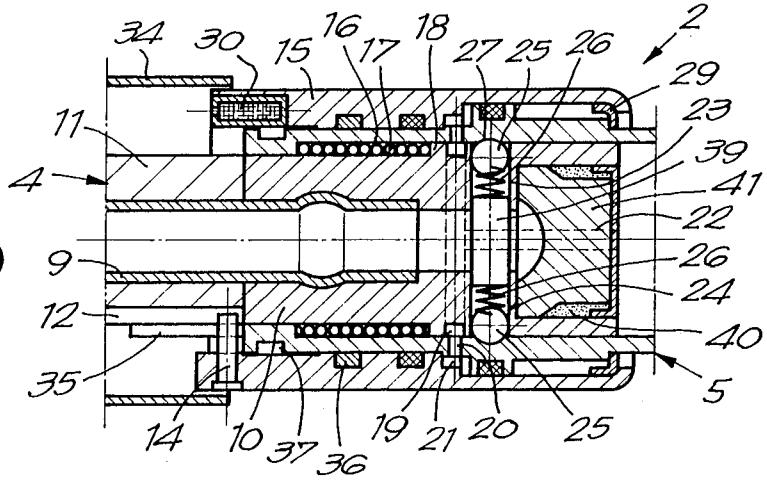
FIG. 10 is a view similar to that of FIG. 4, but for an alternative embodiment.

FIG. 10 shows an embodiment in which is interposed, between the springs 26, a bar 39 made of frangible material that can be destroyed by the passing ball so as to make the support of the springs 26 disappear.

Figure 11:
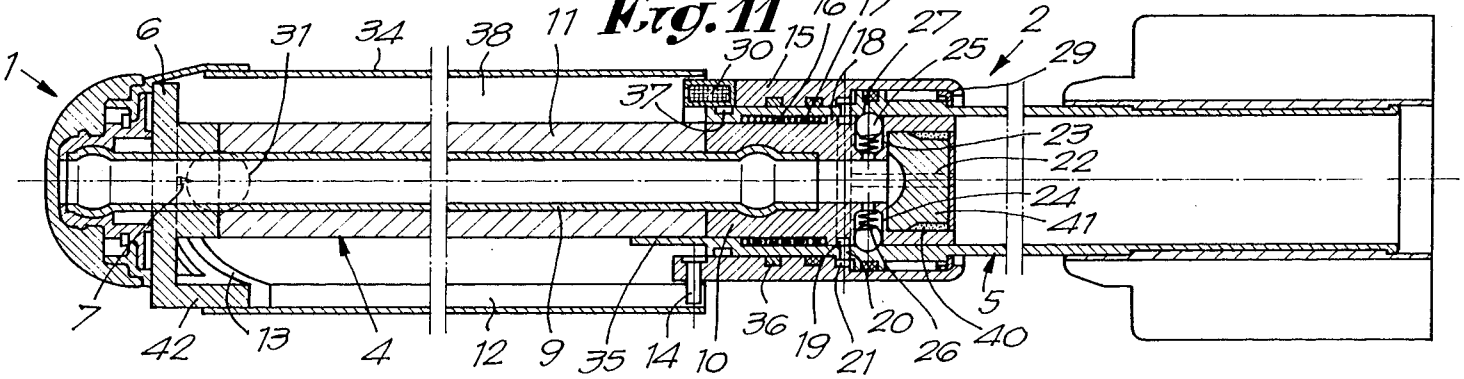
FIG. 11 shows an alternative embodiment of FIG. 2.

FIG. 11 shows an embodiment where the groove 12 is provided for in the tube 34 while the groove 13 is provided for in an extension 42 of the plate 6.

Obviously, numerous changes can be made in the example described above without exceeding the framework of the invention.

What is claimed is:

1. A telescopic grenade of the type with one head and an extended tubular tail that contains an explosive body as well as a detonator chain and with the aforesaid tail made of two telescopic tubular parts of which one part is firmly attached to the aforesaid head and carries, together with the latter, two sections of the aforesaid detonator chain, and of which the other part carries a detonator of this chain, with the grenade provided with guiding means distributed over the aforesaid two parts in order to assign them an angular position depending on their relative axial position, comprising:

a transport/storage position;

means that determine, under the effect of associated propellant gasses, a relative transfer between the other part of the tail and a case which axially slides on said other part;

means for determining the precise relative position of the telescopic tubular parts; and wherein in the transport/storage position an extension is fitted to the other part of the tail to prevent relative movement between the head and said other part.

2. The telescopic grenade according to claim 1, wherein, in, the transport/storage positon an extension is fitted to the other part of the tail.

3. The telescopic grenade according to claim 1, wherein, in the transport/storage position an extension is provided on the plate.

4. The telescoping grenade according to claim 1, wherein the means that determine, under the effect of the propellent gasses, a relative transfer between the other part of the tail and the case comprises at least one groove that communicates with the inside of the other part of the tail and with a circular groove provided in a flange of the one part of the tail and wherein radial holes that communicate the aforesaid circular groove with another groove are provided in the case arranged around an end of the other part of the tail.

5. The telescopic grenade according to claim 4, wherein the aforesaid case carries a detonator.

6. The telescopic grenade according to claim 4, wherein the aforesaid case carries a finger that cooperates with an extended groove.

7. The telescopic grenade according to claim 6, wherein the extended groove is provided in the explosive body.

8. The telescopic grenade according to claim 6, wherein the extended groove is provided for in a tube and in an extension of the plate.

9. The telescopic grenade according to claim 1, including means that guard against an untimely explosion, comprised of a stop against which the case can bear, said stop prompted by a spring exerting a pressure which determines the resistance that the projectile has to encounter before a firing pin can penetrate the detonator.

10. The telescopic grenade according to claim 9, wherein the stop is assembled in the plate that carries the firing pin.

11. The telescopic grenade according to claim 1, including a trajectory beginning position including a tube fitted to the head and surrounding the charge explosive body.

12. A telescopic grenade of the type with one head and an extended tubular tail that contains an explosive charge as well as a detonator chain and with the aforesaid tail made of two telescopic tubular parts of which one part of the tail is firmly attached to the aforesaid head and carries, together with the latter, two sections of the aforesaid detonator chain, and of which the other part of the tail carries a detonator of the chain, the grenade being provided with guiding means distributed over the aforesaid two parts in order to assign them an angular position depending on their relative axial position, comprising:

a transport/storage position;

means that determine, under the effect of associated propellent gasses, a relative transfer between the other part of the tail and a case which axially slides on said other part; and means that determine the precise relative position of the telescopic tubular parts of the tail including one radial chamber provided in a flange, said chamber forming a housing for a ball prompted by a spring, which ball co-acts with a notch provided in the inner wall of the other part of the tail.

13. The telescopic grenade according to claim 12, including diametrically opposed springs between which is interposed a support in the form of a bar made of frangible material.

14. A telescopic grenade of the type with one head and an extended tubular tail that contains an explosive charge as well as a detonator chain and with the aforesaid tail made of two telescopic tubular parts of which one part of the tail is firmly attached to the aforesaid head and carries, together with the latter, two sections of the aforesaid detonator chain, and of which the other part of the tail carries a detonator of the chain, the grenade being provided with guiding means distributed over the aforesaid two parts in order to assign them an angular position depending on their relative axial position, comprising:

a transport/storage position;

means that determine, under the effect of associated propellent gasses, a relative transfer between the other part of the tail and a case which axially slides on said other part; and means that determine the precise relative position of the telescopic tubular parts of the tail and include one radial chamber provided in a flange, said chamber forming a housing for a ball prompted by a spring, which ball co-acts with a notch provided in the inner wall of the other part, the spring being constructed so that it is deformed permanently by launching of a projectile portion of the grenade.

15. A telescopic grenade of the type with one head and an extended tubular tail that contains an explosive charge as well as a detonator chain and with the aforesaid tail made of two telescopic tubular parts of which one part of the tail is firmly attached to the aforesaid head and carries, together wit the latter, two sections of the aforesaid detonator chain, and of which the other part of the tail carries a detonator of the chain, the grenade being provided with guiding means distributed over the aforesaid two parts in order to assign them an angular position depending on their relative axial position; comprising:

a transport/storage position; and means that determine, under the effect of associated propellent gasses, a relative transfer between the other part of the tail and a case which axially slides on said other part, wherein the means that determine a relative transfer between the other part of the tail and the case include one groove that communicates with the inside of the other part of the tail and with a circular groove provided in a flange of the one part, wherein radial holes are provided to communicate the circular groove with another groove provided in the case arranged around an end of the other part, and wherein the case is immobilized on the other part of the tail by means of a bowl that can be deformed under the effect of the propellent gasses on the case.

16. A telescopic grenade of the type with one head and an extended tubular tail that contains an explosive body as well as a detonator chain and with the aforesaid tail made of two telescopic tubular parts of which one part is firmly attached to the aforesaid head and carries, together with the latter, two sections of the aforesaid detonator chain, and of which the other part carries a detonator of this chain, with the grenade provided with guiding means distributed over the aforesaid two parts in order to assign them an angular position depending on their relative axial position, comprising:

a transport/storage position;

means that determine, under the effect of associated propellant gasses, a relative transfer between the other part of the tail and a case which axially slides on said other part;

means for determining the precise relative position of the telescopic tubular parts; and wherein in the transport/storage position an extension is provided on a plate disposed in the head, thereby preventing relative movement between said head and the other part.

17. A telescopic grenade of the type with one head and an extended tubular tail that contains an explosive body as well as a detonator chain and with the aforesaid tail made of two telescopic tubular parts of which one part is firmly attached to the aforesaid head and carries, together with the latter, two sections of the aforesaid detonator chain, and of which the other part carries a detonator of this chain, with the grenade provided with guiding means distributed over the aforesaid two parts in order to assign them an angular position depending on their relative axial position, comprising:

a transport/storage position;

means that determine, under the effect of associated propellant gasses, a relative transfer between the other part of the tail and a case which axially slides on said other part;

means for determining the precise relative position of the telescopic tubular parts; and wherein the means that determine, under the effect of the propellant gasses, a relative transfer between the other part of the tail and the case comprises at least one groove that communicates with the inside of the other part of the tail and with a circular groove provided in a flange of the one part of the tail and wherein radial holes that communicate the aforesaid circular groove with another groove are provided in the case arranged around an end of the other part of the tail.

18. A telescopic grenade of the type with one head and an extended tubular tail that contains an explosive body as well as a detonator chain and with the aforesaid tail made of two telescopic tubular parts of which one part is firmly attached to the aforesaid head and carries, together with the latter, two sections of the aforesaid detonator chain, and of which the other part carries a detonator of this chain, with the grenade provided with guiding means distributed over the aforesaid two parts in order to assign them an angular position depending on their relative axial position, comprising:

a transport/storage position;

means that determine, under the effect of associated propellant gasses, a relative transfer between the other part of the tail and a case which axially slides on said other part;

means for determining the precise relative position of the telescopic tubular parts; and means that guard against an untimely explosion, comprised of a stop against which the case can bear, said stop prompted by a spring exerting a pressure which determines the resistance that the projectile has to encounter before a firing pin can penetrate the detonator.

* * * * *